US005632073A

United States Patent [19]

Foye

[11] Patent Number: 5,632,073

[45] Date of Patent: May 27, 1997

[54] DISH SUPPORT FOR BURIAL CASKET CAP

[75] Inventor: Christopher W. Foye, Oldenburg, Ind.

[73] Assignee: Batesville Casket Company, Inc., Batesville, Ind.

[21] Appl. No.: 458,133

[22] Filed: Jun. 2, 1995

[51] Int. Cl.[6] ..... A61G 17/04

[52] U.S. Cl. ..... 27/19; 27/14

[58] Field of Search ..... 27/14, 18–19

[56] References Cited

U.S. PATENT DOCUMENTS

| | | | |
|---|---|---|---|
| 1,943,094 | 1/1934 | Smysor | 27/14 |
| 2,664,615 | 1/1954 | Hillenbrand et al. . | |
| 3,228,085 | 1/1966 | Nelson | 27/19 |
| 3,407,459 | 10/1968 | Elder | 27/19 |
| 3,831,230 | 8/1974 | Rawlings | 27/19 |
| 3,835,509 | 9/1974 | Esterdahl | 27/19 |
| 4,773,134 | 9/1988 | Kay | 27/14 |
| 4,944,076 | 7/1990 | Kay | 27/14 |

OTHER PUBLICATIONS

Support, Dish Drawing No. PE 000345 Jun. 15, 1993 (1 page).

*Primary Examiner*—Carl D. Friedman
*Assistant Examiner*—Beth A. Aubrey
*Attorney, Agent, or Firm*—Wood, Herron & Evans

[57] ABSTRACT

A casket cap assembly for a burial casket comprises a cap having two sides and two ends defining an interior, having a peripheral edge and having a peripheral groove in the peripheral edge within the interior of the cap. A pair of cap dish assembly supports are positioned in the cap along each cap side. A dish assembly is positioned in the cap and is supported by the cap dish assembly supports. The dish assembly comprises a rectangular cap panel and four peripheral puffing members attached to the periphery of the cap panel at respective adjacent edges. Each support comprises a spacer portion and an arcuate portion separated by a cap dish assembly edge receiving portion. The spacer portion contacts the cap within the cap interior to space the dish assembly relatively within the cap. The edge receiving portion receives therein the respective adjacent edges of the cap panel and puffing members. The arcuate portion defines the curvature of the puffing members. The puffing members have free edges disposed in the cap peripheral groove.

24 Claims, 1 Drawing Sheet

DISH SUPPORT FOR BURIAL CASKET CAP

FIELD OF THE INVENTION

This invention relates generally to burial caskets, and more particularly to casket cap constructions.

BACKGROUND OF THE INVENTION

Caskets have traditionally been in the form of a casket shell to which is pivoted a casket lid or cap. The cap may be the full length of the casket, or the cap may be in two halves, a head end cap and a foot end cap. When the cap is pivoted upwardly to an open position, the underneath or interior of the cap is visible to onlookers. Thus, it has been traditional to outfit the interior of casket caps with decorative materials to provide a visually pleasing appearance when the cap is pivoted to the open position, during, for example, viewing of the deceased in the casket.

Traditionally, caskets lids have been provided with a decorative dish assembly. A dish assembly generally takes the form of a rectangular paperboard cap panel, which may have affixed thereto decorative material, embroidery or the like. Affixed to each of the sides and ends of the rectangular cap panel is a generally trapezoidal-shaped member known as a puffing member. This puffing member is rigid enough to maintain a particular shape when formed into that shape, but not so stiff as to be difficult to form into the desired shape. Generally, each puffing member includes a resiliently flexible substrate of for example paperboard to which is attached decorative fabric. Standoffs may be employed within the casket cap upon which to support the peripheral edges of the cap panel and to locate the dish assembly depthwise within the cap. The free edges of the puffing members are disposed in and retained by a peripheral groove in the peripheral edge of the cap, that is a groove in the interior edge of the cap's side and end members, generally known as rim members. The puffing members are sized so that once the dish assembly is positioned in the casket lid atop standoffs or the like, the puffing members must be formed into a convex shape in order for the free edges of the puffing members to be retained in the cap peripheral groove. The resiliency of the puffing members, when so convexly formed, maintains the cap panel in contact with the standoffs and/or the standoffs in contact with the cap interior.

Heretofore the forming of the puffing members into a convex shape has generally been done by hand, that is to say without the aid of any guide means for forming the convex shape of the puffing members. Consequently, without any guide means beneath the puffing members to maintain them in their convex shape, unsightly gaps can appear at the corners of adjacent puffing members known as "mitre gaps". In addition, if pressure is inadvertently applied to one of the convex puffing members after installation, the puffing members can collapse or be crushed thereby requiring removal of the same and the installation of a new dish assembly.

One solution to the forming of the convex puffing members and retention of those puffing members in a convex state is disclosed in Hillenbrand et al U.S. Pat. No. 2,664,615, assigned to the assignee of the present invention. In that patent, a plurality of webs which are cut in profile to correspond to the desired curvature of the puffing members are attached to the puffing members by means of glue. While such webs maintain the convex shape of the puffing members, installation of the same can be somewhat tedious and time consuming. Furthermore, these webs do not serve to locate the dish assembly depthwise relative to the casket cap.

It has therefore been an objective of the present invention to provide a support for a cap dish assembly which locates the dish assembly depthwise relative to the cap, which provides a curvature guide in forming the convex shape of the puffing members, which provides support to and maintains the puffing members in their convex shape and which is quickly installable into a casket cap.

SUMMARY OF THE INVENTION

The present invention attains the stated objectives by providing a casket cap assembly for a burial casket. The cap assembly comprises a cap having two sides and two ends defining an interior, having a peripheral edge and having a peripheral groove in the peripheral edge within the interior of the cap. A pair of cap dish assembly supports are positioned in the cap along each cap side. A dish assembly is positioned in the cap and is supported by the cap dish assembly supports. The dish assembly comprises a rectangular cap panel and four peripheral puffing members attached to the periphery of the cap panel at respective adjacent edges. Each support comprises a spacer portion and an arcuate portion separated by a cap dish assembly edge receiving portion. The spacer portion contacts the cap within the interior to space the dish assembly relatively within the cap. The edge receiving portion receives therein the respective adjacent edges of the cap panel and puffing members. The arcuate portion defines the curvature of the puffing members. The puffing members have free edges disposed in the cap peripheral groove.

In a preferred form of the present invention, the cap dish assembly support is injection molded of plastic. The support spacer portion, edge receiving portion and arcuate portion comprise an L-shaped member, a clam shell style clip and a quarter-circular member. The L-shaped member has a leg and a foot. The leg has a free end adapted to be placed in contact with the cap interior. The foot forms one half of the clip, with the other half of the clip being a part of one of two generally linear members which connect the ends of the quarter-circular member. The arcuate portion further includes a brace member connected on one end to the quarter-circular member intermediate the quarter-circular member ends and connected on the other end to at least one of the two generally linear members.

The major advantage of the present invention is that a casket cap dish assembly support is provided which locates the dish assembly depthwise within the casket lid, which provides a guide for forming the puffing members into their convex shape, which provides support to those convexly-shaped puffing members after installation to avoid the appearance of mitre gaps and even collapse should the puffing members become inadvertently contacted, and which is quickly and easily installed into a casket cap.

These and other objects and advantages of the present invention will become more readily apparent during the following detailed description taken in conjunction with the drawings herein, in which:

DETAILED DESCRIPTION OF THE INVENTION

Figure 1:
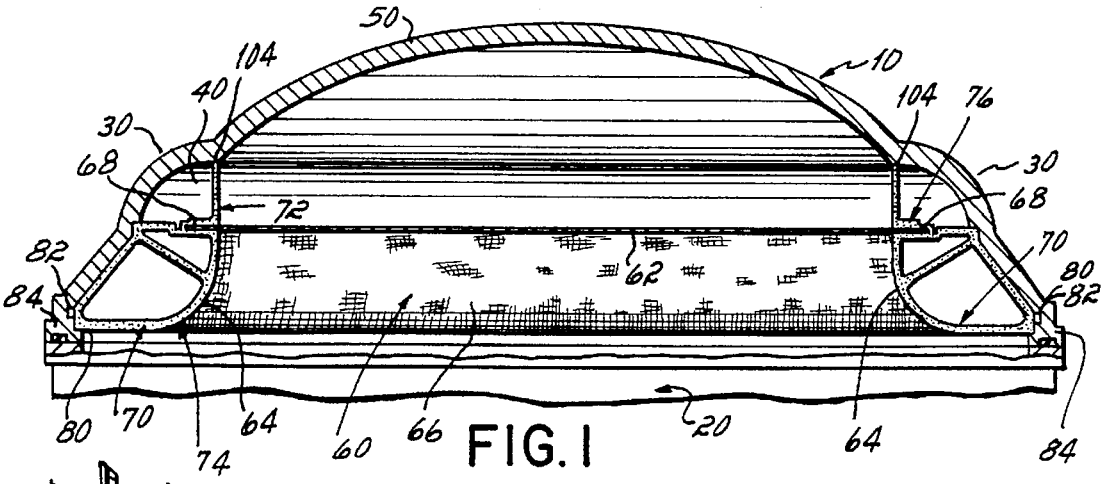
FIG. 1 is a cross-sectional view taken transversely to the length of a casket and illustrating a dish assembly support of the present invention supporting a dish assembly.
Figure 2:
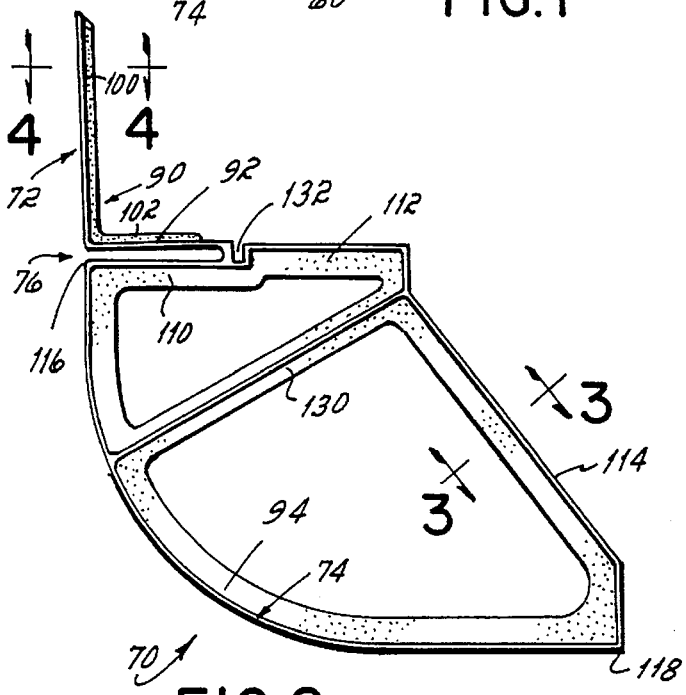
FIG. 2 is a side elevational view of the dish assembly support of the present invention.

Referring first to FIG. 1, there is illustrated a casket cap 10 mounted upon a casket shell 20 by hinges or other means known to those skilled in the art. The view in FIG. 1 is a transverse cross-sectional view taken through the casket cap and shell transversely to the length of the cap and shell. The cap 10 includes a pair of sides or side rim members 30 to which are connected a pair of ends or end rim members, one of which is shown at 40. A crown 50 is attached to the sides 30 and ends 40. A dish assembly 60 is supported within the cap 10 by a dish assembly support 70. The dish assembly 60 is comprised of a rectangular cap panel 62 and peripheral puffing members attached to the periphery of the cap panel 62 at respective adjacent edges. In FIG. 1, side puffing members 64 and end puffing member 66 are illustrated. The side puffing members 64 are illustrated as attached to the periphery of the cap panel 62 at adjacent edges 68. The end puffing members 66 are similarly attached to the cap panel at adjacent edges, but are not seen in FIG. 1.

Referring now to FIGS. 1–4, the dish assembly support 70 of the present invention is illustrated in more detail. The support 70 comprises a spacer portion 72, an arcuate portion 74 and a cap dish assembly edge receiving portion 76. The spacer portion 72 contacts the cap 10 within the interior to space the dish assembly 60 depthwise relatively within the cap 10. The edge receiving portion 76 receives therein the respective adjacent edges of the cap panel and puffing members, for example illustrated at 68 in FIG. 1. The arcuate portion 74 defines the curvature of the side and end puffing members 64 and 66 respectively as will be subsequently described. When installed in the cap 10, the free edges 80 of the puffing members 64 and 66 are disposed in a peripheral groove 82 in the peripheral edge 84 within the interior of the cap 10.

Figure 3:
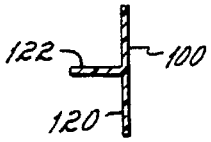
FIG. 3 is a view taken along lines 3—3 of FIG. 2.
Figure 4:
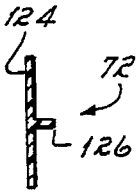
FIG. 4 is a view taken along lines 4—4 of FIG. 2.

More particularly, the cap dish assembly support 70 is preferably injection molded of plastic. The support spacer portion 72, edge receiving portion 76 and arcuate portion 74 comprise an L-shaped member 90, a clam shell style clip 92 and a quarter-circular member 94. The L-shaped member 90 has a leg 100 and a foot 102. The free end of the leg 100 is adapted to be placed in contact with the cap interior, as upon ledge 104 (FIG. 1). The foot 102 forms one half of the clip 92. The other half 110 of the clip 92 is part of a generally linear member 112 which is connected to a second generally linear member 114 both of which connect the ends 116, 118 of the quarter-circular member 94. As seen in FIGS. 3 and 4, the cross-section of the support 70 is generally in the form of a T-section having a base 120 and a web 122 (FIG. 3), and a similar base 124 and a shorter web 126 (FIG. 4) associated with the L-shaped member 90. An additional brace member 130 is connected on one end to the quarter-circular member 94 intermediate the quarter-circular members ends 116, 118 and is connected on the other end to the generally linear members 112, 114. A relief or notch 132 allows for flexing of the L-shaped member 90 relative to the balance of the support 70 to open the edge-receiving portion 76 to receive the edge of the dish assembly therein. The clam shell style clip 92 which is the edge-receiving portion 76 is formed, when injection molded, to be in a generally closed position so that after foot 102 is pivoted away from portion 110 by applying force to leg 100 to allow insertion therein of the edge 68 of the cap dish assembly 60 foot 120 returns to its near closed position resiliently retaining the edge 68 therein.

Figure 5:
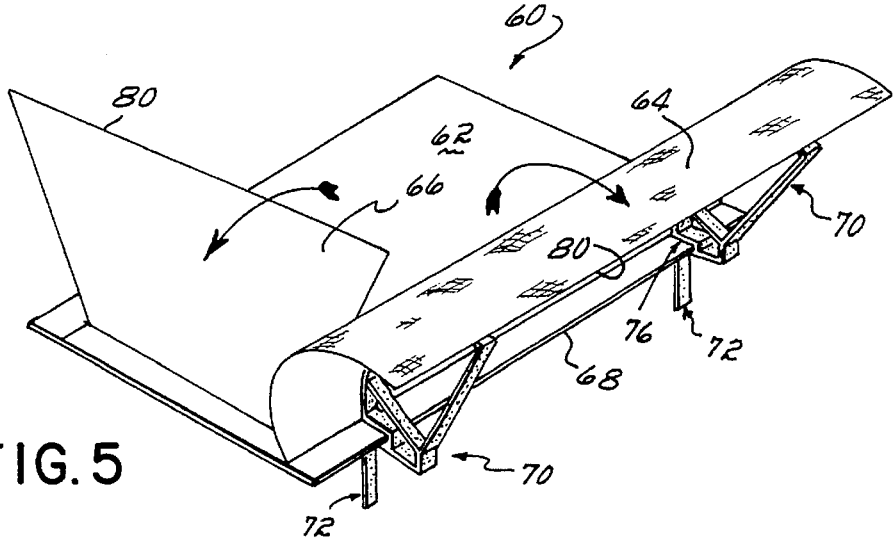
FIG. 5 is a perspective view of a dish assembly with dish assembly supports of the present invention.

Referring now to FIG. 5, installation of the supports 70 onto the dish assembly 60 is illustrated. Preferably two supports 70 are utilized on each side of the dish assembly 60. After receipt of edge 68 in clips 92, the dish assembly 60 with four supports 70 installed thereto is inserted into cap 10. Upon engagement of the legs 100 with the ledges 104, the side puffing members 64 are curved about the quarter-circular members 94 and the free edges 80 of the puffing members 64 are tucked into the grooves 82 in the side rim members 30. As the ends of the side puffing member 64 will provide adequate support for the end puffing members 66, no supports 70 need be installed on the ends of the dish assembly 60. Rather, the ends of the end puffing members 66 overlap the ends of the side puffing members 64, the ends of the side puffing members 64 thus defining the curvature of the end puffing members 66. As the ends of the side puffing members 64 are adequately supported by the supports 70, any inadvertent pressure on those puffing members 64 will not produce any mitre gap at the joint between the side puffing members and end puffing members 64, 66 respectively. Further, since the ends of the end puffing members 66 are supported by the ends of the side puffing members 64, any inadvertent pressure on the end puffing members 66 closes, rather than opens, any mitre gap thereat. Thus, the supports 70 not only position the dish assembly 60 depthwise relative to the cap 10, but they also provide a means of guiding the puffing members into their proper curvature, provide a means of resisting collapse when pressure is applied to the puffings, and prevent mitre gaps from appearing at the corners of the puffings. Further, the supports 70 provide for quick and easy installation of the dish assembly 60 into the cap 10.

Those skilled in the art will readily recognize numerous adaptations and modifications which can be made to the present invention and which will result in an improved cap dish assembly support, yet all of which will fall within the spirit and scope of the present invention as defined in the following claims. Accordingly, the invention is to be limited only by the scope of the following claims and their equivalents.

What is claimed is:

1. A casket cap assembly for a burial casket comprising:

a cap having two sides and two ends defining an interior, having a peripheral edge and having a peripheral groove in said peripheral edge within said interior of said cap;

a pair of cap dish assembly supports positioned in said cap along each said cap side; and a dish assembly positioned in said cap and supported by said cap dish assembly supports, said dish assembly comprising a rectangular cap panel and four peripheral puffing members attached to the periphery of said cap panel at respective adjacent edges;

each said support comprising a spacer portion and an arcuate portion separated by a cap dish assembly edge receiving portion, said spacer portion contacting said cap within said interior to space said dish assembly relatively within said cap, said edge receiving portion receiving therein said respective adjacent edges of said cap panel and puffing members, said arcuate portion defining the curvature of said puffing members, said puffing members having free edges disposed in said cap peripheral groove.

2. The casket cap assembly of claim 1 wherein each said cap dish assembly support is injection molded of plastic.

3. The casket cap assembly of claim 1 wherein said support spacer portion, edge receiving portion and arcuate portion comprise:

an L-shaped member;

a clam shell style clip; and a quarter-circular member;

said L-shaped member having a leg and a foot, said leg having a free end adapted to be placed in contact with said cap interior, said foot forming one half of said clip, the other half of said clip being a part of one of two generally linear members which connect the ends of said quarter-circular member.

4. The casket cap assembly of claim 3 wherein said arcuate portion further includes a brace member connected on one end to said quarter-circular member intermediate said quarter-circular member ends and connected on the other end to at least one of said two generally linear members.

5. A burial casket having a casket shell and a cap assembly pivoted to said shell, said cap assembly comprising:

a cap having two sides and two ends defining an interior, having a peripheral edge and having a peripheral groove in said peripheral edge within said interior of said cap;

at least one cap dish assembly support positioned in said cap along each said cap side; and a dish assembly positioned in said cap and supported by said at least one cap dish assembly support, said dish assembly comprising a cap panel and puffing members attached to the periphery of said cap panel at respective adjacent edges;

said at least one support comprising a spacer portion and an arcuate portion separated by a cap dish assembly edge receiving portion, said spacer portion contacting said cap within said interior to space said dish assembly relatively within said cap, said edge receiving portion receiving therein said respective adjacent edges of said cap panel and puffing members, said arcuate portion defining the curvature of said puffing members, said puffing members having free edges disposed in said cap peripheral groove.

6. The casket of claim 5 wherein said at least one cap dish assembly support is injection molded plastic.

7. The casket of claim 5 wherein said support spacer portion, edge receiving portion and arcuate portion comprise:

an L-shaped member;

a clam shell style clip; and a quarter-circular member;

said L-shaped member having a leg and a foot, said leg having a free end adapted to be placed in contact with said cap interior, said foot forming one half of said clip, the other half of said clip being a part of one of two generally linear members which connect the ends of said quarter-circular member.

8. The casket of claim 7 wherein said arcuate portion further includes a brace member connected on one end to said quarter-circular member intermediate said quarter-circular member ends and connected on the other end to at least one of said two generally linear members.

9. A cap dish assembly support adapted to be positioned in a casket cap to support a cap dish assembly having a cap panel and peripheral puffing members attached to the periphery of the cap panel, said support comprising:

a spacer portion;

an arcuate portion; and a cap dish assembly edge receiving portion disposed between said spacer and arcuate portions;

said spacer portion adapted to contact the cap within the cap interior to space the dish assembly relatively within the cap, said edge receiving portion adapted to receive therein at least one of an edge of the cap panel and an adjacent edge of the puffing member, said arcuate portion adapted to define the curvature of the puffing members when the free edges of the puffing members are disposed in a peripheral groove in the cap.

10. The cap dish assembly support of claim 9 wherein said support is injection molded of plastic.

11. A cap dish assembly support adapted to be positioned in a casket cap to support a cap dish assembly having a cap panel and peripheral puffing members attached to the periphery of the cap panel, said support comprising:

a spacer portion;

an arcuate portion; and a cap dish assembly edge receiving portion disposed between said spacer and arcuate portions;

said spacer portion adapted to contact the cap within the cap interior to space the dish assembly relatively within the cap, said edge receiving portion adapted to receive therein an edge of the cap dish assembly, said arcuate portion adapted to define the curvature of the puffing members when the free edges of the puffing members are disposed in a peripheral groove in the cap;

wherein said support spacer portion, edge receiving portion and arcuate portion comprise:

an L-shaped member;

a clam shell style clip; and a quarter-circular member;

said L-shaped member having a leg and a foot, said leg having a free end adapted to be placed in contact with said cap interior, said quarter-circular member having a pair of ends which are connected by a pair of generally linear members, said foot forming one half of said clip, the other half of said clip being a part of one of said pair of generally linear members.

12. The cap dish assembly support of claim 11 wherein said arcuate portion further includes a brace member connected on one end to said quarter-circular member intermediate said quarter-circular member ends and connected on the other end to at least one of said pair of generally linear members.

13. A casket cap assembly for a burial casket comprising:

a cap having two sides and two ends defining an interior, having a peripheral edge and having a peripheral groove in said peripheral edge within said interior of said cap;

a pair of cap dish assembly supports positioned in said cap along each said cap side; and a dish assembly positioned in said cap and supported by said cap dish assembly supports, said dish assembly comprising a rectangular cap panel and four peripheral puffing members attached to the periphery of said cap panel at respective adjacent edges;

each said support comprising an arcuate portion and a cap dish assembly edge receiving portion, said edge receiving portion receiving therein said respective adjacent edges of said cap panel and puffing members, said arcuate portion defining the curvature of said puffing members, said puffing members having free edges disposed in said cap peripheral groove.

14. The casket cap assembly of claim 13 wherein each said cap dish assembly support is injection molded of plastic.

15. The casket cap assembly of claim 13 wherein said edge receiving portion and arcuate portion comprise:

a clam shell style clip; and a quarter-circular member;

one half of said clip being formed by a first linear member, the other half of said clip being a part of a second generally linear member connected to an end of said quarter-circular member.

16. The casket cap assembly of claim 15 wherein said arcuate portion further includes a brace member connected on one end to said quarter-circular member intermediate the ends of said quarter-circular member and connected on the other end to said second linear member.

17. A burial casket having a casket shell and a cap assembly pivoted to said shell, said cap assembly comprising:

a cap having two sides and two ends defining an interior, having a peripheral edge and having a peripheral groove in said peripheral edge within said interior of said cap;

at least one cap dish assembly support positioned in said cap along each said cap side; and a dish assembly positioned in said cap and supported by said at least one cap dish assembly support, said dish assembly comprising a cap panel and puffing members attached to the periphery of said cap panel at respective adjacent edges;

said at least one support comprising an arcuate portion and a cap dish assembly edge receiving portion, said edge receiving portion receiving therein said respective adjacent edges of said cap panel and puffing members, said arcuate portion defining the curvature of said puffing members, said puffing members having free edges disposed in said cap peripheral groove.

18. The casket of claim 17 wherein said at least one cap dish assembly support is injection molded plastic.

19. The casket of claim 17 wherein said edge receiving portion and arcuate portion comprise:

a clam shell style clip; and a quarter-circular member;

one half of said clip being formed by a first linear member, the other half of said clip being a part of a second generally linear member connected to an end of said quarter-circular member.

20. The casket of claim 19 wherein said arcuate portion further includes a brace member connected on one end to said quarter-circular member intermediate the ends of said quarter-circular member and connected on the other end to said second linear member.

21. A cap dish assembly support adapted to be positioned in a casket cap to support a cap dish assembly having a cap panel and peripheral puffing members attached to the periphery of the cap panel, said support comprising:

an arcuate portion; and a cap dish assembly edge receiving portion connected to said arcuate portion;

said edge receiving portion adapted to receive therein at least one of an edge of the cap panel and an adjacent edge of the puffing member, said arcuate portion adapted to define the curvature of the puffing members when the free edges of the puffing members are disposed in a peripheral groove in the cap.

22. The cap dish assembly support of claims 21 wherein said support is injection molded of plastic.

23. The cap dish assembly support of claim 21 wherein said support edge receiving portion and arcuate portion comprise:

a clam shell style clip; and a quarter-circular member;

one-half of said clip being formed by a first linear member, the other half of said clip being a part of a second generally linear member connected to an end of said quarter-circular member.

24. The cap dish assembly support of claim 23 wherein said arcuate portion further includes a brace member connected on one end to said quarter-circular member intermediate the ends of said quarter-circular member and connected on the other end to said second linear member.

* * * * *